US005688152A

United States Patent [19]

Rodskier

[11] Patent Number: 5,688,152

[45] Date of Patent: Nov. 18, 1997

[54] MARINE DRIVE UNIT WITH THE PRIMARY SHAFT BEARING MOUNTED IN THE ENGINE FLYWHEEL COVER

[75] Inventor: Christian Rodskier, Torslanda, Sweden

[73] Assignee: AB Volvo Penta, Gothenburg, Sweden

[21] Appl. No.: 719,536

[22] Filed: Sep. 25, 1996

[30] Foreign Application Priority Data

Sep. 25, 1995 [SE] Sweden ..... 9503311-4

[51] Int. Cl.[6] ..... B63H 23/24

[52] U.S. Cl. ..... 440/83; 440/112

[58] Field of Search ..... 440/111–113, 83, 440/52, 53, 56, 57, 64; 114/183 R, 197, 198

[56] References Cited

U.S. PATENT DOCUMENTS

| | | | |
|---|---|---|---|
| 3,368,517 | 2/1968 | Macdonald | 440/57 |
| 3,865,068 | 2/1975 | Haasl . | |
| 4,370,138 | 1/1983 | Wilka . | |

*Primary Examiner*—Edwin L. Swinehart

*Attorney, Agent, or Firm*—Young & Thompson

[57] ABSTRACT

A marine drive unit in combination with a coupling (6) between the engine (4) and the propeller drive unit (2). The unit has a divided flywheel cover (20), the proximal portion (22) of which is joined to the engine and has an axially extending section (25) with a connecting portion (38), which has, as seen in the drawing, an inner profile which is upwardly tapered both longitudinally and transversely to the drive unit. A primary shaft (16) is joined via drive knuckles (15) to the propeller drive unit (2) and is borne in a bearing (28) mounted in a seat (27) in a first end of a bearing holder (26). The primary shaft (16) engages a flywheel (19). The other end of the bearing holder (26) is joined to the distal portion (24) of the flywheel cover. The distal portion (24) has a supporting portion (31) with an exterior profile complementary to the interior profile of the connecting portion (38). The proximal portion (22) of the flywheel cover can be anchored to its distal portion (24) via a screw (42) and the bearing holder (26) has a rubber element (32) welded to its outside, the rubber element being mounted in abutment with a shoulder (36) in a passage (12) in a bushing elements (10) fixed in the boat transom (9).

10 Claims, 3 Drawing Sheets

MARINE DRIVE UNIT WITH THE PRIMARY SHAFT BEARING MOUNTED IN THE ENGINE FLYWHEEL COVER

FIELD OF THE INVENTION

The invention relates to a marine drive unit with engine suspension in combination with a coupling between the engine and the propeller drive, said device comprising: a beating holder joined to the engine flywheel cover, said bearing holder having a seat for a bearing to a shaft extending from the engine, said shaft being a primary shaft in a drive unit, and a resilient element, which is disposed between the bearing holder and a bushing means arranged on the transom and partially penetrating the same.

BACKGROUND OF THE INVENTION

A marine drive unit of the above mentioned type is known by U.S. Pat. No. 3,865,068 and comprises a three-point mounting of the engine with the primary shaft bearing mounted in the distal end of a housing extending from the engine. The primary shaft is enclosed in said housing. A resilient sealing element is arranged about the drive shaft housing and is expanded radially inside a cylindrical passage through the transom, to thereby support the engine in the portion immediately adjacent to the drive knuckles and seal the penetrating passage from water.

It is advantageous, as in the known marine drive unit, to mount the primary shaft in the flywheel cover and as close to the drive knuckles as possible in order to facilitate correct alignment, which reduces the vibrations which can be generated by the drive knuckles.

An additional advantage of this arrangement is that the aft engine mounting is located close to the knuckles, which means that for a given misalignment of the engine, the knuckle alignment will be affected less, i.e. less vibration will be generated.

This means that the flywheel cover must be constructed with a correspondingly extended neck for the bearing, and this in turn means that the engine, with the fits required, will be difficult to mount, since it must be tilted at the same time as the cover neck with the resilient element mounted thereon must be inserted into its place in the bushing means, due to the fact that the space in the engine compartment is as a rule limited (too short).

In order to facilitate the mounting of the engine, the bearing could instead be mounted in the bushing means thus making it possible to eliminate the neck of the flywheel cover. The disadvantage of such an arrangement is that any minor deviation of the engine alignment relative to the bearing, or if the engine mountings settle, the shaft will be misaligned. This causes an oblique loading of the engine shaft coupling resulting in vibrations, which can result in breakdown. The vibrations can be reduced by using a special rubber coupling, which is, however, expensive. If the engine alignment requirements are high, the installation time will also be long.

An optimization of the advantages of these two designs would involve mounting the primary shaft bearing in the flywheel cover, thus not subjecting the primary shaft to any bending stresses and insulating the bearing by means of the resilient element from the boat at the same time as making the engine simply mountable in the boat.

SUMMARY OF THE INVENTION

The purpose of the present invention is therefore to achieve a marine drive unit, which is simple, reliable and inexpensive and which is more simple to install in a boat than previously and where the advantages of the primary shaft bearing mounted in the engine flywheel cover are retained.

This is achieved according to the invention by virtue of the fact that the flywheel cover is divided and has a proximal portion which is joined to the engine and has a connecting portion, and a distal portion which is joined to the bearing holder and has a supporting portion, shaped to complement the connecting portion, and that the engine, when the connecting portion is in precise contact x,y with the supporting portion, is correctly aligned in relation to the bearing mounted in the beating holder seat.

According to a further development of the marine drive unit, water flow is prevented into the boat, should the outboard unit of the propeller drive be broken off. This and other advantageous further developments and improvements of the invention are possible by the steps disclosed in the subclaims and in the following description.

BRIEF DESCRIPTION OF THE DRAWINGS

The advantages of the invention will be evident from the following description with reference to examples shown in the accompanying schematic drawings.

DETAILED DESCRIPTION OF THE INVENTION

Figure 1:
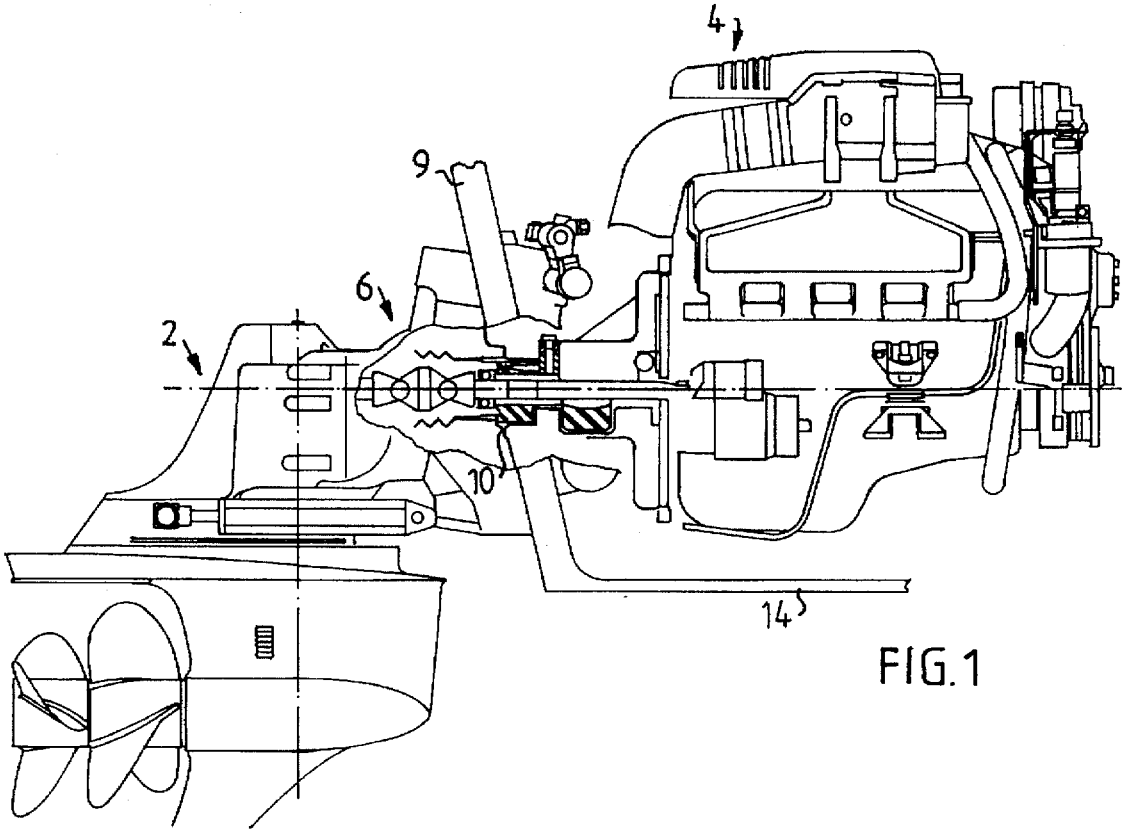
FIG. 1 shows a partially sectioned marine drive unit according to the invention.

2 in FIG. 1 generally designates a boat propeller drive of so-called Inboard-Outboard type (INU), for example a Duoprop® drive and 4 designates an engine coupled to the drive 2. The connection between the engine and the propeller drive is generally designated 6 and has a support unit 8, which is constructed about a bushing means in the form of a flanged bushing 10, which is fixed in a transom 9. The bushing means 10 protects the passage 12 through the transom for the driving shaft. The transom 9 is connected, as shown in FIG. 1, to a boat bottom 14.

The shaft 16 from the engine 4 runs through the passage 12 and via drive knuckles 15 to the propeller drive 2. This is the primary shaft of the drive unit. On the engine side, the primary shaft 16 can be in the form of a splined shaft which fits into a corresponding hub portion in an oscillation damper 18 in the form of an elastic coupling to an engine flywheel 19. The flywheel is covered at least on one side (on the top of the drive unit as seen in the drawing) by a flywheel cover 20, which is divided into two interconnectable portions, a proximal portion 22 and a distal portion 24. The proximal portion 22 is joined in a conventional manner to the engine 4 and has a section 25 extending towards the drive knuckles, while the distal portion 24 is joined to an end of a tubular bearing holder 26, which has, in an opposite end there-of, a seat 27 for a bearing 28 for the primary shaft 16. The distal portion 24 is preferably forced onto the end of the bearing holder 26 and is anchored thereto by means of rivets. A lock ring 30 is inserted into a groove designed therefor in the bearing seat 27, to hold the bearing 28 in the seat. The distal portion 24 has a wedge-shaped supporting portion 31 extending radially from the bearing holder 26, for engagement with the projecting section 25 of the proximal portion of the flywheel cover.

A resilient element in the form of a rubber element 32, for example, is welded to the outside of the bearing holder between the proximal portion 24 of the flywheel cover and the beating seat 27. The rubber element has a cylindrical exterior which is welded in a mounting sleeve 34 and is suitably excentrically oriented on the tubular bearing holder 26 in such a manner that a thicker rubber layer is located radially opposite to the supporting portion 31 on the bearing holder.

Figure 4:
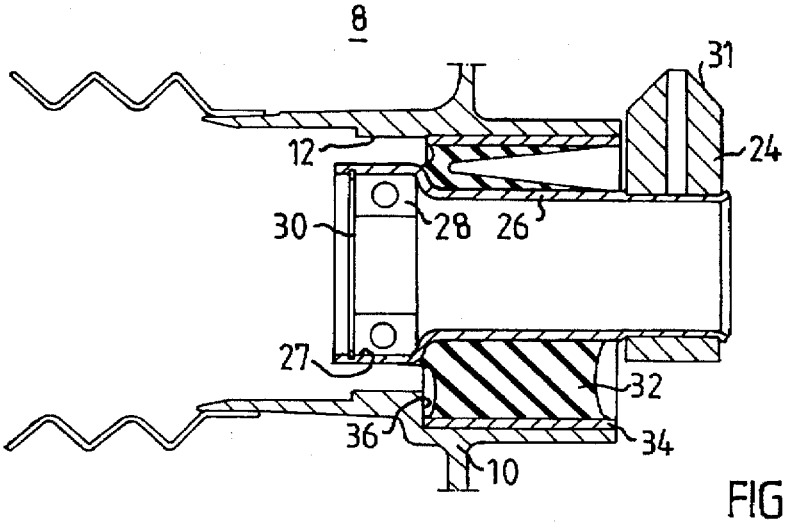
FIG. 4 shows the coupling prior to mounting of the engine.

In the passage 12, a recess for the rubber element is made with a shoulder 36, against which the mounting sleeve 34 for the rubber element is pressed during assembly. Prior thereto, one must make sure that the bearing holder is oriented so that the thicker layer of the rubber element is oriented towards the boat bottom 14. The support unit 8 described above is shown in FIG. 4 prior to mounting of the engine 4 and the primary shaft 16 joined to the drive knuckles 15.

The bearing holder 26 with associated parts is premounted with the rubber element 32 in the bushing means 10, and the distal portion 24 of the flywheel cover is oriented by means of the bearing holder with its wedge-shaped supporting portion 31 upwardly directed as seen in the drawing. As was described previously, the proximal portion 22 of the flywheel cover is joined to the engine 4, but has also a connecting portion 38 on section 25, which, in accordance with a preferred embodiment is made with an interior profile which is upwardly tapered in both the longitudinal and transverse directions of the drive unit. The proximal portion 22 of the flywheel cover and its projecting section 25 form essentially a right angle with each other and are joined to each other with an angle reinforcement 20.

Figure 3:
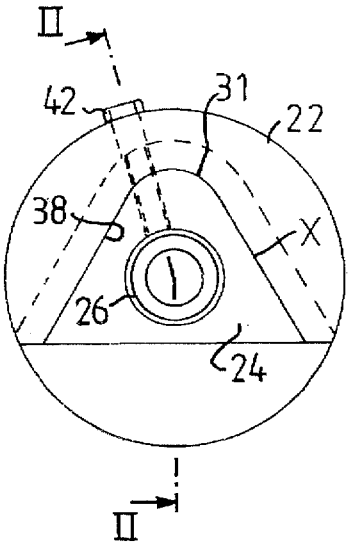
FIG. 3 shows a section through the coupling of FIG. 2 along the line III—III in FIG. 2
Figure 5:
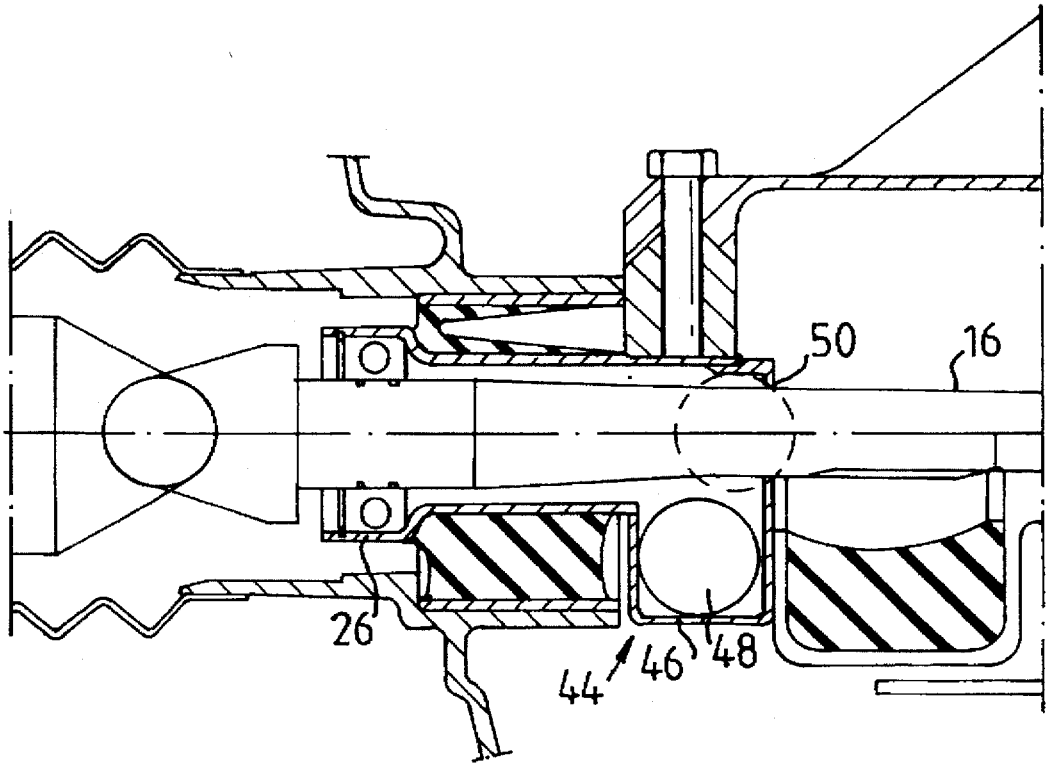
FIG. 5 shows a variant of the coupling equipped with a floater valve.

The connecting portion 38 is made, in the transverse direction of the drive unit, with an interior profile x, which is, as can best be seen in FIG. 3, tapered upwards as seen in the drawing with an acute angle. Tests have shown that the tapered angle should be acute to achieve exact position of the connecting portion 38 relative to the supporting portion 31. Taper angles in the interval 45°–75° provide a satisfactory positioning, and a taper angle of 60° has proved to be optimal as regards both positioning and strength aspects.

Figure 2:
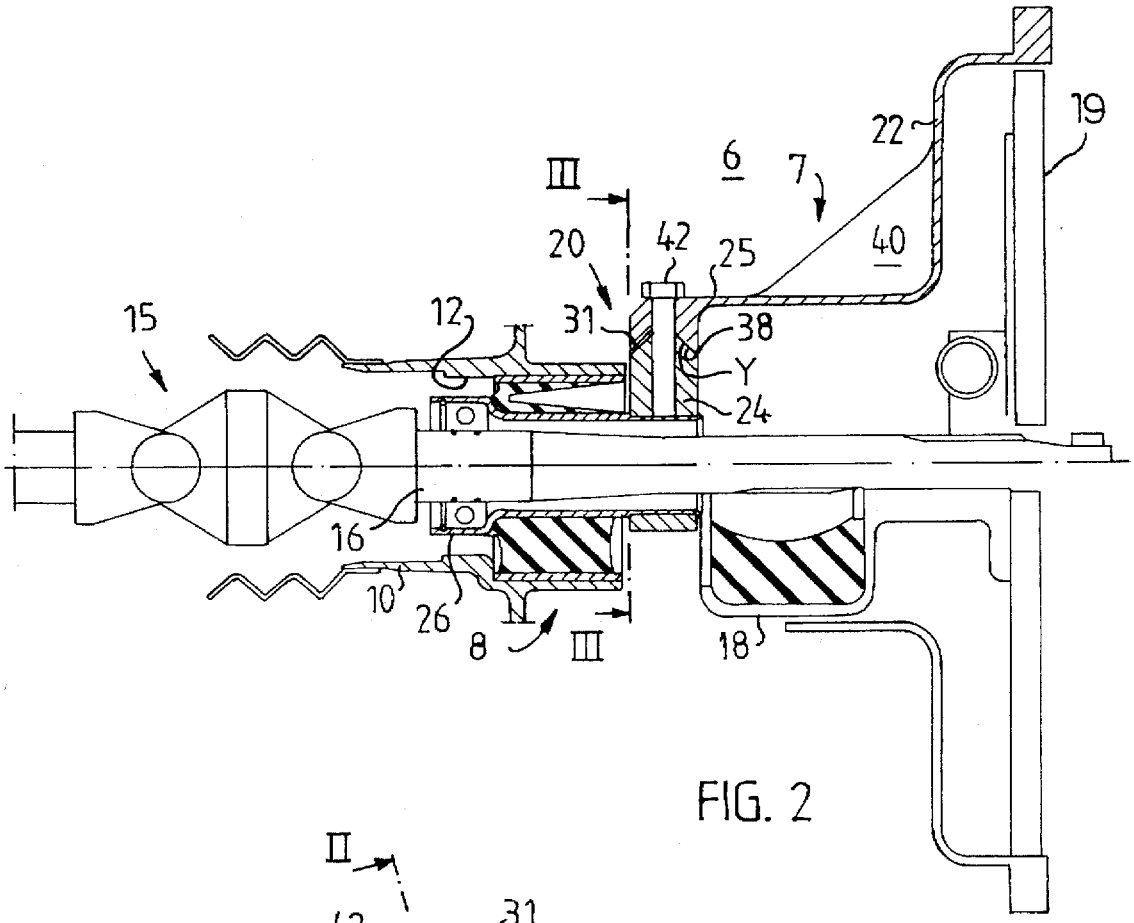
FIG. 2 shows the coupling of FIG. 1 on a larger scale, sectioned along the line II—II shown in FIG. 3.

In the longitudinal direction of the unit, the inner profile y of the connecting portion is, as can best be seen in FIG. 2, also upwardly tapered as seen in the drawing. In the same manner as for the transverse profile x, the tapered angle for the longitudinal profile y was determined by trials and it is primarily for strength reasons that it has been given a flatter angle than what is the case for the transverse profile x. The longitudinal profile y thus has an angle in the interval 80°–100° and is preferably 90°. Both the profiles x and y are planed and rounded in the narrowest portion of the respective profile. According to a preferred embodiment, the longitudinal profile y consists of a groove running along the transverse profile with slanted edges and a planed bottom.

A threaded lock screw 42 can be screwed through the proximal portion 22 into corresponding threads in the distal portion 24. For reasons of space, the lock screw is mounted non-symmetrically to one side or the other of the vertical axis of symmetry as seen in the drawing of the coupling 6.

In order to keep water from entering through the shaft opening in the transom, should the propeller drive unit 2 be broken off, by running aground at high-speed for example, so that the primary shaft 16 also is pulled out and leaves a 35 mm hole in the boat beneath the waterline, the beating holder is, according to a further developed embodiment, equipped with a floater valve 44. The floater valve has a body 46 located adjacent the other end of the beating holder, in which a pingpong ball 48 is located in its ready position. An opening in the end of the bearing holder 26 is a valve seat 50 adapted to the ball. When the shaft 16 is removed and water is forced in through the shaft hole in the bearing 26, the cup 46 is filled with water, and the pingpong ball 48 will float on the water to sealing by contact with the valve seat 50. In a simple manner, the boat is thus prevented from sinking should the propeller drive be broken off.

With the marine drive unit according to the invention, there is thus achieved a simple installation of both the engine and the propeller drive in the boat, since the engine can be dropped directly down into the boat, there being no long neck extending from the flywheel cover. The upwardly tapered profile of the connecting portion 38 guides the engine correctly even if it should be lowered somewhat out of alignment. Better alignment of the drive knuckles is achieved by virtue of the fact that the aft-engine mounting, i.e. the rubber element 32, is located close to the knuckles. By means of the lock screw 42, a secure anchoring of the distal portion 24 in the proximal portion 22 of the flywheel cover is obtained. This in turn means that the bearing 28 mounted in the bearing holder 26 will always be correctly aligned relative to the engine independent of the position in the aft-engine mounting 32. The lock screw is placed so that it is easily accessible for tightening but even if the screw should be forgotten or lost, the engine cannot come loose due to the fact that the primary shaft is still held inside the beating holder 26, thus preventing the proximal portion 22 of the flywheel cover from being removed from its distal portion 24.

Within the scope of the claims, it is also possible to exchange places between the outer profile 31 and the inner profile 38 so that the interior profile is on the distal portion 24 and the exterior profile is on the axially extending section 25 of the proximal portion 22 of the flywheel cover.

I claim:

1. In a marine drive unit with engine mounting in combination with a coupling between an engine and a propeller drive, said unit comprising a bearing holder joined to a flywheel cover, said bearing holder having a seat for a bearing for a shaft extending from the engine, said shaft being a primary shaft in the drive unit, and a resilient element which is disposed between the bearing holder and a bushing means arranged on a boat transom and partially penetrating said boat transom, the improvement wherein the flywheel cover is divided and has a proximal portion joined to the engine and having a connecting portion, and a distal portion joined to the bearing holder and having a supporting portion, shaped to complement the connecting portion, and the engine, when the connecting portion is in precise contact with the supporting portion, is correctly aligned in relation to the bearing mounted in the bearing holder seat.

2. Marine drive unit according to claim 1, wherein the resilient element is a rubber element, which is welded to the bearing holder and the rubber element with attached bearing holder and flywheel cover distal portion joined thereto is mounted in contact with a shoulder and a bushing means in such a manner that the distal portion of the flywheel cover is located on the engine side of means, and means, and the bearing is located in a passage in the bushing means.

3. Marine drive unit according to claim 1, further comprising a floater valve with a float which can move between a ready position and an operating position, said float being disposed in its ready position between the primary shaft and a bottom of the boat, whereby if the shaft is removed and water rushes in through an opening for the primary shaft in the bearing holder, the float floats on the water to its operating position in sealing relation to the opening in the bearing holder.

4. Marine drive unit according to claim 3, wherein the float is a ball, the ready position is defined by a cup, and the opening for the primary shaft is made as a valve seat adapted for the ball.

5. Marine drive unit according to claim 1, wherein the connecting portion has a flat contact surface.

6. Marine drive unit according to claim 1, wherein one of the connecting portion and the supporting portion has a contact surface in the form of an inner profile.

7. Marine drive unit according to claim 6, wherein the inner profile is a profile tapered in one direction both transversely and longitudinally to the drive unit.

8. Marine drive unit according to claim 6, wherein the inner profile is V-shaped in at least one plane lying perpendicular to a central axis of the primary shaft.

9. Marine drive unit according to claim 1, wherein the connecting portion is securely anchorable to the supporting portion by means of a fastener element.

10. Marine drive unit according to claim 9, wherein the fastener element is a screw fastener, which can be anchored by means of a threaded screw.

* * * * *